United States Patent [19]

Drydyk

[11] 3,967,520

[45] July 6, 1976

[54] GUITAR CHORDING DEVICE FOR KEYBOARD INSTRUMENTS

[76] Inventor: Lawrence A. Drydyk, 13010 W. Park Ave., New Berlin, Wis. 53151

[22] Filed: Nov. 18, 1974

[21] Appl. No.: 524,982

[52] U.S. Cl. ..... 84/1.01; 84/DIG. 2; 84/DIG. 22

[51] Int. Cl.[2] ..... G10H 1/02; G10H 5/02

[58] Field of Search ..... 84/1.01, 1.03, 1.17, 84/1.24, DIG. 12, DIG. 22, DIG. 2

[56] References Cited

UNITED STATES PATENTS

| | | | |
|---|---|---|---|
| 3,198,055 | 8/1965 | Von Gunten | 84/1.17 UX |
| 3,358,070 | 12/1967 | Young | 84/1.17 |
| 3,432,607 | 3/1969 | Bergman | 84/1.17 |
| 3,617,602 | 11/1971 | Kniepkamp | 84/1.17 |
| 3,651,729 | 3/1972 | Adachi | 84/1.17 |
| 3,715,442 | 2/1973 | Freeman | 84/1.01 |
| 3,718,748 | 2/1973 | Bunger | 84/1.24 |
| 3,725,562 | 4/1973 | Munch, Jr. et al. | 84/1.24 |
| 3,757,024 | 9/1973 | Stinson, Jr. et al. | 84/1.17 |
| 3,780,203 | 12/1973 | Petrie | 84/1.17 |
| 3,842,184 | 10/1974 | Kniepkamp et al. | 84/1.01 |
| 3,854,366 | 12/1974 | Deutsch | 84/1.24 |

*Primary Examiner*—L. T. Hix
*Assistant Examiner*—Stanley J. Witkowski
*Attorney, Agent, or Firm*—Andrus, Sceales, Starke & Sawall

[57] ABSTRACT

A keyboard input such as the lower manual of an organ includes a plurality of keys covering one or more octaves. A plurality of note sources are provided which can produce the essential notes required for open harmony presentation of the various chords of a guitar and are grouped to represent one set of notes for each guitar string. Preferential switching relays provide re-structuring of conventional close harmony chords into open harmony, and have windings connected in circuit by switches coupled to keys and connect the essential notes for a chord in each group to an output line. The output lines are connected to a sequence timer which transmits the outputs to an audio circuit to produce a synthesized strumming sound output and in open harmony in the same manner as the guitar instrument.

19 Claims, 1 Drawing Figure

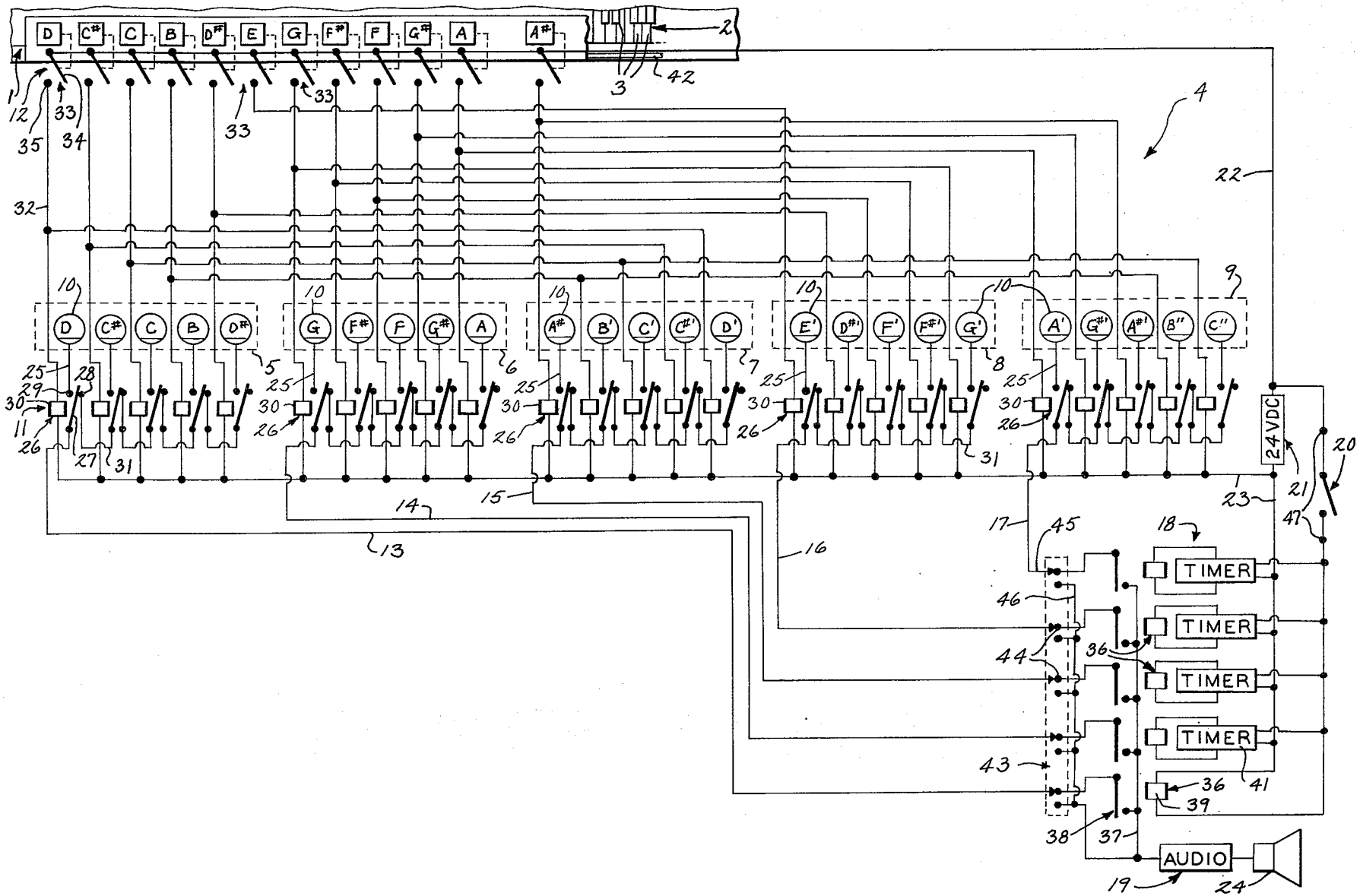
24VDC
TIMER
TIMER
TIMER
TIMER
AUDIO

GUITAR CHORDING DEVICE FOR KEYBOARD INSTRUMENTS

BACKGROUND OF THE INVENTION

This invention relates to an apparatus for generating string instrument sounds and particularly chords such as played on a guitar or similar string instrument.

Plucked string instruments, such as a guitar, develop a unique sound characteristic. Although various electronic synthesizers have been employed with keyboard inputs to generate musical sound effects, there is none which truly reflects the characteristics of a string instrument such as a guitar. Applicant's analysis has shown that a string instrument synthesizer must include various unique aspects of a string instrument. Thus, in a guitar, the striking of the strings develops a unique harmonic structure including a rapid attack and gradual decay development as a result of striking of the string itself. In addition, the voicing of a guitar chord is in "open harmony" and covers roughly two octaves. Finally, in the playing of the guitar chord, there is a distinct strumming effect resulting from a slight delay between each note of the chord as the chord is played. Applicant has realized that, in order to accurately attain the desired guitar effect, the several characteristics of the actual guitar instrument must be considered including the tonal characteristics, the forming of the chord in open harmony and finally the final execution of each of the notes of the chords.

SUMMARY OF THE PRESENT INVENTION

The present invention is thus particularly directed to a synthetic sound arranging apparatus which can generate a musical sound output essentially corresponding to the unique sound characteristic of plucked string instruments and particularly a guitar. Generally, in accordance with the teaching of the present invention, a unique voicing section is provided to permit the restructuring of conventional one-hand chords to open harmony chords while maintaining each of the notes essential to a chord. The strumming of a plucked string instrument is produced by introducing a slight delay between each note of the chord. The voicing section particularly produces a chord in open harmony extended over a plurality of octaves. Generally, the distinction between open harmony and closed harmony may be considered in terms of keyboard generated chords and guitar chords. Thus, in a keyboard instrument, the three or four notes of a chord are played on one hand and within one octave to generate a close harmony chord. In contrast, a guitar chord will consist of five or six notes spread in open harmony over roughly two octaves. In accordance with a particularly unique aspect of this invention, the open harmony chord is generated and extended over approximately two octaves and may be generated by playing in a single octave of a keyboard instrument such as the lower manual of an organ, the lefthand section of a piano, the button section of an accordian, the chord section of auto-chord organs or the like, which is played by one hand of the performer. In accordance with a practical and novel construction and feature of the present invention, a plurality of tone generators or source means are provided which can produce the various notes required for the various chords. The several tone source means are selectively interconnected to an output sound circuit through a unique selection system which is adapted to be actuated from a piano or organ keyboard of a corresponding piano or organ or any other manual or automatic input selection means. The tone source means are grouped to provide a plurality of groups in accordance with the number of strings on the instrument to be simulated. A preferential source selection means in each group is coupled to the keyboard input means to achieve the desired voicing of each chord in a manner corresponding essentially to that of a guitar. Voicing, in the context of this invention, pertains to the arrangement or distribution of the notes of a chord. Each group has an output line connected to a suitable timing means for transmission to an audio signal output means in timed relation to essentially effect the strumming of the string instrument.

The same notes from all octavely related keys are interconnected to actuate the appropriate tone generator and permit playing from any register on the keyboard.

More particularly, in a highly practical application, five tone generators representative of each individual string of a guitar are provided, each of the generators in the different groups being operable to generate a uniquely different sound from the first and second octaves. The several octave generators in the several groups are activated through a preferential switching means from the corresponding keyboard.

Further, the several keys from each octave on the keyboard include paralleled switches such that a guitar chord may be played with one hand any place within any one octave register on the keyboard. Thus, manually responsive switches may be coupled to the keys to selectively energize the preferential switching means. The preferential switching means includes series connected switches for each group to a string output line such that the switch closest the line has preference for connecting of its tone generator to the string output line. The several individual string lines, in turn, are sequentially connected to audio ouput processing circuitry through an automatic sequential time.

Applicant has found that the present invention permits formation of a keyboard instrument which will play full open harmony chords extended over two octaves with one hand while generating the effect of an actual guitar or the like. In this aspect of the invention, the device, as designed, operates primarily as an accompaniment section to a keyboard instrument and it may be particularly incorporated into the lower manual of an organ, the left-hand section of a piano, the button section of an accordian or the like in such a manner as to facilitate accompaniment and creation of rythmic effects superimposed on the performer's normal presentation.

The structure of this invention may also provide for other interconnection of automatic controls for activation of the timing means in any predetermined manner, for keying of the guitar string outputs and may, of course, be employed to generate solo sound effects such as directly playing chorded melodies in open harmony chording.

BRIEF DESCRIPTION OF DRAWING

The drawing furnished herewith illustrates a preferred construction of the present invention in which the above advantages and features are clearly disclosed as well as others which will be readily understood from the following description of such embodiment.

The drawing is a schematic circuit diagram of an automatic guitar chording device with a keyboard input and clearly illustrating one embodiment of the present invention.

DESCRIPTION OF THE ILLUSTRATED EMBODIMENT

Referring to the drawing, the present invention is illustrated in connection with a keyboard instrument 1 such as a piano, an organ or the like, of which only a fragmentary portion of the keyboard 2 is illustrated. The keyboard 2, for purposes of description, will be referred to an organ and is shown including a plurality of adjacent keys 3 with the adjacent groups of keys developing the several notes inclusive of one octave. The keys 3 of the organ 1 will, of course, generate the conventional organ sound output. In accordance with the present invention, each of the keys 3 is coupled through a preferential selection means to selectively activate an electronic sound synthesizer 4 to simulate and generate output sounds in accordance with a plucked string instrument. The sound synthesizer 4 of the illustrated embodiment of the invention is adapted to authentically generate the chords of a guitar, and includes five groups 5, 6, 7, 8 and 9 of different tone generators 10, one group representing a different one of each of the strings. The several tone generators 10 in each of the groups 5, 6, 7, 8 and 9 are individually connected through a preferential switch assembly 11 coupled to a selection switch assembly 12 operated by the keys 3 of the keyboard 2.

The illustrated keyboard 2 of which only a fragmentary portion is shown thus includes the conventional white and black keys 3 arranged in the conventional manner. The first or lower register of the keyboard 2 is shown in the illustrated emobodment of the invention to activate the guitar sound synthesizer 4 and is shown with the keys identified by note blocks which are rearranged in the drawing in an order providing convenient illustration of the circuit connection to the several tone or note sources in the five groups 5–9, as more fully developed hereinafter. The associated keys 3 will be arranged in the conventional organ keyboard system and played directly in accordance with conventional construction, with the several key switches 12 connected into the circuit as illustrated in the drawing and hereinafter described. Each of the groups 5–9 has a corresponding single string output line 13–17 connected to a timing control means or unit 18 which selectively and in sequence, with proper timed delay, transmit the sound signals to an audio processing signal network 19. A main control or keying switch means 20 activates the timing unit 19 to provide for selective transmission of the sound signals.

The illustrated switching system is adapted to be driven from a low voltage source diagrammatically illustrated in the embodiment as a twenty-four volt DC power supply 21, including a main signal line 22 and a common return line 23 selectively connected to energize the several circuits as subsequently described.

The output signal processing networks 19 may, of course, be any suitable construction and is shown in block diagram coupled to drive a speaker 24 or the like. The keyboard instrument and the audio signal processing network may thus be of any known or desired construction and no further detailed illustration or description thereof is given other than is necessary to clearly explain the functioning and operation of the present invention.

The several tone generator groups are generally similarly constructed. The first group 5 of generators will be described in detail, with the corresponding other groups briefly described to clearly explain the system.

The group 5 as illustrated is provided with five tone signal generators or sources 10 respectively generating frequencies corresponding to the notes D, C sharp, C, B and D sharp in the first octave. Thus, in the drawing the first octave sources are shown by the notes, the second octave with primed notes and the third octave with double primed notes. Each of the tone generators 10 may be a suitable oscillator or other suitable frequency means for deriving the appropriate frequency which is continuously operated and includes an output generator ine 25 which is selectively connected to the output string line 13 through the preferential switching unit 11.

The illustrated preferential switching unit 11 includes similar switch elements selectively connected to each other and to the generator lines 25 for transmitting of a single tone from the group to the string line 13. The illustrated switching unit 11 includes similar, individual relays 26 for each of the tone generators 10 and that for the D note generator is described in detail with corresponding other relays identified by corresponding note-related numbers. The illustrated relay 26 is a single, pole double throw switch unit having a common pole 27 selectively engaging a transfer contact 28 in a normal state and operable to engage a tone generator contact 29. A relay winding 30 is electromagnetically coupled to the common pole 27 for selectively moving of the pole to the tone signal contact 29.

In the stand-by position, the contact pole 27 disconnects the ouput string line 13 from the D note generator line 25 and connects it to the transfer contact 28, which is connected via a transfer lead 31 to the C sharp note relay common pole 27 for the next preferred or C sharp tone generator 10. The latter relay unit similarly, when energized, connects the C sharp note tone generator for connection to the string line 13 or in the normal, deenergized state connects the adjacent note tone generator through its relay unit for connection to such line 13, shown as the C note generator. The B note generator 10 and the D sharp note generator 10 are similarly connected in series to string line 13 through the preceding preferred note relay units.

The several windings 30 of the several relays 26 are selectively connected or energized through the keyboard switch network 12.

Thus, the one side of the relay winding 30 is connected to the common return side and line 23 of the power supply 21. The opposite side of the relay winding 30 is selectively connected to the positive power supply line 22 via a line 32 to a keyboard switch 33 of the switch assembly 12. Each illustrated switch 33 is a single-pole, single-throw unit having a switch pole 34 coupled to the corresponding note key and moved to engage a contact 35. The pole 34 is connected to supply line 22 and contact 35 is connected to the related relay winding line 32. Thus, the D tone generator has its relay winding 26 connected to a D key switch contact 33.

Thus, when the D note key 3 is depressed, the associated relay 26 is energized, moves the relay pole or arm 27 to engage the tone output contact 29 and connects the output of the D note tone generator 10 directly to the first string line 13. Similarly, striking any one of the C sharp, C, B, and D sharp note keys will cause a corresponding energization of the associate relay unit 26 and the connection of the corresponding tone generator 10 to the first string line 13. In the event two of these note keys 3 are simultaneously actuated, only the first in the series will be connected to the string line 13. For example, actuaction of the relay 26 associated with the D note generator 10 results in the opening of the series circuit to the other generators at the contact 28. The other relays can not, therefore, cause transmission of the note signal to line 13. D note has the greatest priority or preference in the first string group. In sequence, the priority proceeds to the notes C sharp, C, B and D sharp in the illustrated embodiment.

The keys 3 for controlling of D, C sharp, C, B and D sharp tone generation of the first string group 5 are also connected to selectively control tone generators 10 in the other groups 7–9 for the same note but of a different octave. The other groups 6–9 employ those keys in combination with the other seven keys 3 of the one octave register.

Thus, the second string group 6 is related in an identical manner with the keys 3 for G, F sharp, F, G sharp and A notes of the first ocatve, with the switching preference being similarly connected to the string line 14.

The third group 7 for the third string consists of A sharp, B′, C′, C sharp′, and D′ tone generators 10, while the fourth group 8 includes the tone generators E′, D sharp′, F′, F sharp′ and G′ and finally the fifth string group covers the tone generators A′, G sharp′, A sharp′, B″ and C″.

In summary, when playing a chord consisting typically of three or four harmonically related notes, activation of the keys 3 from the one register activates a single tone generator in each group in accordance with the actual chording of a guitar. For example, the C sixth chord requires the notes, C, E, G and A which are simultaneously held by depressing of the corresponding keys 3 of the keyboard.

Activation of the C note key 3 closes the associated switch 33, energizes the associated relay 26 of group 1 and thereby couples the C note tone generator 10 of the first group 5 to the string line 13. The C key switch 33 is also operatively connected to C′ note of group 7 and the C″ note of group 9. The note C″ is, however, cut out by the preferential switching as described below.

Actuation of the second note E key 3 closes its associated switch 33 which energizes the first relay unit 26 in the fourth group 8 and thereby connects the E′ note tone generator 10 of the fourth group 8 to the fourth string line 16.

The G note key 3 closes its switch 33 and simultaneously energizes the first relay 26 in the second group 6 and the final relay 26 in the fourth group 8. In the second group 6, the connection of the first tone generator 10 ensures its connection to the second string line 14. The energization of the G′ tone relay 26 in the fourth group 8 connects the G′ note generator 10 to the corresponding transfer line 31. The tone will be generated and transferred down through the several contacts and transfer lines 31 to the E′ note relay contact 28. At this point, however, the circuit is broken as a result of the energization of the E′ note relay 26 for the fourth group as a result of the activation of the E key 3. Consequently, its energization does not affect the desired transmission of the E note through the preferential switch means in the fourth group.

Finally, the activation of the final A key 3 results in the simultaneous energizing of the A tone generator relays 26 in the second group 6 and simultaneously the A′ note in the fifth group 9. In the second group 6, the A tone generator 10 is the final selection in the set. The selection of the G note relay 26 which is the first tone generator in the group 6 breaks the circuit and, consequently, the energization of the A note relay in the second group 6 does not provide for effective transmission of the note A. In the fifth string group 9, however, the C″ note relay 26 and the A′ note relay 26 has been energized, but only the A note tone generator 10 is coupled to the fifth string line 17, again as the result of the preferential switch.

Consequently, the five key strings 13–17 have been activated by the striking of the four keys of the keyboard 2 to activate and operatively couple the generators 10 from the five sets consisting of the C, G, C′, E′ and A′ generators, respectively. This conditions and couples the string lines 13–17 to the desired tone signals. The signals are transferred via the timing network 18 to the audio signal processing network 19 in response to activation of the final keying or control switch 20 which selectively energizes the timing network.

In the illustrated embodiment of the invention, the timing network 18 includes a plurality of similar relays 36 for separately connecting of the several strings 13–17 to a common output line 37. The first string relay 36 includes a set of contacts 38 connected between the first string line 13 and the common line 37. Each of the other relays 36 includes similar contacts similarly connected between the appropriate line 14–17 and the common output line 37. The first string relay 36 has its winding 39 connected directly to the power supply 21 via the control signal switch 20. All other relays 36 for strings 14–17 are actuated through a related, individual timer 41 which, in turn, is connected to the power supply 21 via the keying switch 20. Timer 41 may be any suitable timing module such as a Model 6224-203 manufactured and sold by Hi-G of Conn. The timers 41 have sequentially longer time periods to provide energization of the relays 36 for the second, third, fourth and fifth strings 14–17 in time delayed sequence. Thus the timer 41 for the second string line 14 may be selected with a fifteen millisecond delay, that for the third string with a 30 millisecond delay, that for the fourth string with a 45 millisecond delay and that for the fifth string with a 60 millisecond delay.

In summary, when keying switch 20 closes, it simultaneously energizes the several timers 41 and the first string relay 36. The first string relay 36 closes immediately to transmit the first string tone. The second string timer 41 times out after fifteen milliseconds and transmits the tone from the second string line 14. The third, fourth and fifth string timers 41 operate 30, 45 and 60 milliseconds respectively after the first string relay to transmit in time spaced relation the corresponding signals from line 14–17.

The delayed output creates an output closely following that of a guitar, wherein the guitarist can sequentially strike individual strings in playing a chord such that there necessarily is some momentary delay between the striking of that string and the next string.

The control or keying switch 20 is preferably arranged to be actuated from any position on the keyboard 2. For example, a ribbon-type switch or a capacitive responsive switch element is mounted to extend over the full length of the keyboard 2 as at 42 on the rail directly in front of the keys 3. The performer can then sustain a chord any place on the keyboard and actuate the switch 20 with the palm of his hand to introduce the guitar chord with a strumming effect at the desired time. In an organ, the effect would be a sustained closed harmony chord sounded by the normal organ operation in combination with the open harmony guitar chord activated by the switch 20. This, in effect, not only introduces electronic harmony guitar sound but permits a single performer to produce the effect of a pair of performers. Thus, in the example given, the combination would be that of a separate organist sustaining a chord in the lower keyboard in close harmony, while a separate performer strummed the guitar chord at the appropriate time, for example, on the offbeats of the music.

Further, the strumming effect can, of course, be controlled if desired by providing adjustable timers 41 to vary the time period before the transmission of the related string sounds.

Generally speaking the illustrated embodiment of the invention provides for the playing of essentially all of the significant chords. The illustrated generated tone combinations are those which have been found to produce an exceptionally pleasing output closely and essentially following the actual output of a guitar. Various combinations and revisions might be introduced into the system.

The notes selected for each set, as illustrated, are essentially based on the normal interval between each of five strings of an actual guitar. The particular sequence is arrived at by arrangement which insures that all notes esential to the chord are present, and by generally subjective evaluation of the most pleasing voice arrangement. The latter can be varied as desired.

In the illustrated embodiment of the invention, a jack connector 43 is illustrated providing for individual jack inputs or taps 44 to the several string lines 13–17. This would permit further combining of the illustrate apparatus with other external chording devicing. For example, each note of a guitar chord may be keyed in externally by other devices such as arpeggiators. This would also provide an improved output in that the arppegios could be played with greater precision as each contact of the arpgiator responds to selected notes rather than having the notes respond at various distances along the arpeggiator. The same terminal connector 43 would also provide for keying in a desired note of a chord through an automatic rhythm device such that the notes of the chord can be "connected" or selected in rhythm similar to the fingering of a guitar to generate various rhythm chords, or operated manually, which is schematically illustrated in the drawing. Thus a two position switch 45 is shown connected between the string lines 13–17 and the taps 44. In the alternate position, the several switches 45 connect the lines 13–17 to a common line 46. The switches 45, when forming a part of an arpeggiator, would, of course, be actuated by the usual operating means.

A jack or tap unit 47 may also be desirably paralleled with the switch 20 to permit the strumming effect to be keyed in externally such as by suitable automatic rhythm device. For example, in the illustrated embodiment of this application the close harmony chord would be sustained by the operator's hand on the lower keyboard and the guitar sound keyed in automatically in a predetermined rhythm pattern.

Further, in the illustrated embodiment the keying switch is struck after conditioning of each group in order to introduce the strummed guitar output. Selection switches could be provided with the keyboard keys for simultaneous energization of the string relays and the several timing devices to initiate the cycle and play the notes.

Thus, a plurality of keys similar to key 20 may be located under each key of a keyboard, under the pedal or pedals or other operator and parallel connected for operation upon depression of the corresponding operator. Similar normally closed switches could be series connected to complete the circuit upon release of the operator. Further, key coupled switches could be pressure responsive and require an additional pressure to be applied before the output circuit is to be completed.

Any further combinations can, of course, be introduced into the system through the simple addition of additional note sets employing duplication of the illustrated sets to correspond to the number of additional notes required.

In the illustrated embodiment of the invention, manually operated switches and relays are illustrated for simplicity and clarity of explanation. Obviously, the several mechanical switches, relays and the like can be readily replaced with any suitable solid state elements such as transistors, controlled rectifiers and the like. Further, mechanical switch actuation can be readily replaced with other forms of non-mechanical switch controlling means, such as capacitive, photoelectric, electromagnetic and the like. Such detail will be readily apparent to those familiar with the art of electrical circuit design and such combinations and modifications are not illustrated or further described herein.

In any event, the several sets of string related tone source groups include the necessary notes from at least the first and second octaves to thereby generate the desired open harmony chord presentation while allowing playing of the five or six note chord with one hand and within the one octave of the keyboard. The illustrated embodiment of the invention thus permits the electronic generating of a guitar instrument chord giving due consideration to the significant characteristics of the guitar including the harmonic structure with the rapid attack and gradual decay of a guitar string as well as the "open harmony " chording, playing of the chord in combination with the actual strumming effect, in order to produce a true sound effect obtained with an actual guitar.

Although illustrated with a five string output effect, it can, obviously, be readily extended to a six string effect by duplicating group 9 two octaves lower. Applicant has constructed both a six and a five string system essentially closely following the output of a guitar. Guitarists do not generally play all six strings when forming a chord and the five string group was selected as being most typical.

Where the present instrument is applied to an electronic keyboard instrument such as an electronic organ already having appropriate tone generators, the present invention may incorporate directly to use of such tone generators into the several tone generating goups. Alternatively, it may, of course, be constructed with completely separate tone generators for such an instrument or for use with any other keyboard instrument which does not employ electronic sound or separate tone generators.

Further, although shown with tone generators such as presently employed in various electronic instruments, the present invention could actually employ string type elements having strikers for activating of the corresponding string as the appropriate time. The total instrument illustrated is constucted to simulate an actual guitar and with the voicing or preferential switching section maintaining the desired output.

The present invention has thus been found to provide a highly improved keyboard instrument producing an actual guitar chord and, in particular, providing open harmony chords extended over two octaves by operation of the keyboard with one hand. Although the unit will normally employ a keyboard, any other suitable input, including a programmed means, could, of course, be employed to operate the novel voicing section to obtain the complete restructured one-hand chord in open harmony.

Various modes of carrying out the invention are contemplated as being within the scope of the following claims, particularly pointing out and distinctly claiming the subject matter which is regarded as the invention.

I claim:

1. An apparatus comprising a plurality of individual tone generating sections, a plurality of output connecting means, one for each section, each of said sections including a plurality of tone source means each operable to form an audio frequency signal for a selected musical note and each section defining a different combination of notes from that of the other sections with selected notes repeated in different sections, a preferential switch and circuit means including switch means in each section for each of said note source means, each of said sections having circuit means connecting said switch means in each section to each other and to said output connecting means for connecting of said tone source means of a section to a corresponding output connecting means for that section, said switch means in each section being connected in a preferential order with said switch means completing the circuit from the connecting means to the one tone source means and breaking the circuit to the other tone source means of the same section and whereby with two switch means activated in one section only one preferred tone source means is connected to the output connecting means of said section to define a preferential order of notes in each section, said sections having a tone source means operable to develop the note which was disconnected in a different section by said switch means and connected to the related connecting means as a preferential note, and common means for operating of the switch means for all tone source means for the same note in said sections whereby simultaneously activating one or more of the switch means in said sections generates a selected note at each of said output connecting means, said preferential order controlling the particular note impressed on the output connecting means in each section and generates an audibly pleasing voicing sequence.

2. The apparatus of claim 1 wherein different sections include tone source means for the same note in different octaves and said preferential switch and circuit means operates to present to tone source means in different octaves and thereby create a musical chord in open harmony.

3. The apparatus of claim 2 for generating of open harmony guitar chords, said source means being selected for each section to produce the notes created by a selected guitar string.

4. The apparatus of claim 1 including an automatic strumming means connected to said output connecting means and operable to transmit the sound signal therefrom in a predetermined, delayed sequence.

5. The apparatus of claim 4 including a strumming control means for selectively activating said automatic strumming means.

6. The apparatus of claim 1 for playing essentially all musical chords wherein the several sections include tone source means for notes from different octaves and in combination provide all notes essential to the musical chords.

7. In a keyboard type apparatus for generating of musical sound from a keyboard having a plurality of different note keys comrising a plurality of tone source means for generating the individual notes of string instrument chords, said tone source means arranged in a plurality of sequentially activated groups of tone source means, each group being related to a selected string of a plucked string instrument and having a corresponding string output line, each of said groups including preferential switching means including switch means for each of said tone source means, each group having circuit means connecting said switch means in each section to each other and to said string output line for connecting the output of the tone source means in each group to the corresponding string output line said switch means in each group being connected in a preferential order with said switch means closing the circuit to the one tone source means and opening the circuit to other tone source means of the same group, whereby with two switch means activated in one group only one preferred tone source means is connected to the output connecting line of said group to define a preferential order of notes in each group, said groups having said tone source means distributed in different groups to develop the note of a tone source means which has been disconnected by the switch means in a different group and connected to the related output line as a preferential note, and common means for operating of the switch means for all tone source means for the same note in said groups whereby simultaneously activating a selected plurality of the switch means combines the tone source means to present tone signals playing a chord in open harmony.

8. The keyboard apparatus of claim 7 wherein said keyboard covers a plurality of octaves, each of said groups having the tone source means connected to all corresponding note keys of the several octaves whereby activation of a key in any octave energizes at least one of said preferential switching means to operatively connect said tone source means to the output line.

9. The apparatus of claim 7 including a strumming means including an audio output means for producing an audible output and timing means connected to said string output lines and to said audio output means to sequentially transmit the signals from said string output lines providing for sequential presentation of the tone signal in accordance with the plucking of individual strings of a string instrument.

10. The apparatus of claim 9 wherein said timing means includes individual switch means connected between each of the string lines and a common audio input line, operators for sequentially closing said switch means and including means for activating of the second and all following string lines in times sequence after operation of the switch means for the first string line.

11. The apparatus of claim 9 wherein said keyboard includes a plurality of key registers one for each octave, the corresponding note keys of each register having individual switch means for opening and closing of a circuit path, each of the corresponding note keys of each of said registers being connected in parallel to the corresponding of said tone source means of said groups whereby the striking of the note key in any register results in closing of the circuit path for connection of all corresponding tone source means.

12. The apparatus of claim 9 having a strumming control switch means extended along the length of the keyboard and operable essentially from any position on said keyboard while maintaining of the fingers on the keyboard.

13. The apparatus of claim 7 including a releasable connection means connected to each of said string lines for selective connection to external devices.

14. In the apparatus of claim 7 wherein said plurality of keys includes at least one group of keys covering a complete octave and adapted to be played by one hand of a performer, means connecting of said tone source means into said plurality of groups each of which is related to a guitar string to generate musical notes of the guitar string, each of said groups including a similar plurality of said tone source means with each group including tone source means of different octaves being distributed into different groups, tone switch means for each tone source means having a first normally closed conductive position connected in series with each of the other switches and each having an alternate conducting position connected to the output of the tone source means to thereby introduce said tone into said series circuit, the series connection of said switches defining said preferential order connection to the corresponding string output line, each of said tone switch means including an operator having an input means for operating of the switch means, each of the keys of said keyboard having a control switch means connected to the input means for the corresponding tone switch means to provide actuation of each of the switch means related to said tone independent of the octave whereby actuation of selected keys results in simultaneous connection of the different octave tone source means in the several groups to the corresponding string output line, said preferential switching resulting in connection of a single tone source means to each string line.

15. The keyboard instrument of claim 9 wherein said strumming means includes separate sequential switch means for sequentially connecting of said string lines to the audio output means, and a strumming control switch means for activating of said strumming switching means to sequentially transmit the tone on said string lines in said predetermined order.

16. The apparatus of claim 15 wherein strumming control switch means extend along the length of the keyboard and is operable essentially from any position on said keyboard while maintaining of the fingers on the keyboard.

17. The apparatus of claim 14 including a releasable connection means connected to each of said string lines for selective connection to external devices.

18. The apparatus of claim 14 including twenty-five tone source means divided into first, second, third, fourth and fifth string groups, a first group including tone source means covering notes from a first octave and defining a preferential order of the notes D, C sharp, C B and D sharp, said second string group including tone source means selecting signals for the second string and defining a preferential order of the notes G, F sharp, F, G sharp and A from the same octave as said first group, said third string group similarly including in preferential order tone source means for A sharp from the same octave as the first and second group and B, C, C sharp and D from a second octave, said fourth string group including tone source covering notes from the second octave and defining a preferential order of the notes E, D sharp, F, F sharp and G, and said fifth string group including tone source means defining a preferential order of the notes A, G sharp and A sharp from the second octave and notes B and C from a third octave.

19. The apparatus of claim 18 wherein said strumming switching means activates a timing network to immediately transmit the first string and to sequentially actuate the second, third, fourth and fifth strings at succeeding 15 millisecond intervals.

* * * * *